US008057152B1

(12) United States Patent
White

(10) Patent No.: US 8,057,152 B1
(45) Date of Patent: Nov. 15, 2011

(54) WHEELCHAIR LIFTING APPARATUS

(76) Inventor: William D. White, Bradenton, FL (US)

( * ) Notice: Subject to any disclaimer, the term of this patent is extended or adjusted under 35 U.S.C. 154(b) by 675 days.

(21) Appl. No.: 12/082,568

(22) Filed: Apr. 11, 2008

(51) Int. Cl.
*B65F 1/00* (2006.01)

(52) U.S. Cl. ..... 414/546; 414/921; 414/537

(58) Field of Classification Search ..... 414/537, 414/921, 540, 541, 546
See application file for complete search history.

(56) References Cited

U.S. PATENT DOCUMENTS

| | | | | |
|---|---|---|---|---|
| 4,058,228 | A * | 11/1977 | Hall | 414/549 |
| 5,375,962 | A * | 12/1994 | Kempf | 414/541 |
| 7,264,433 | B2 | 9/2007 | Navarro | |
| 7,404,382 | B2 * | 7/2008 | Ling et al. | 123/90.12 |
| 2007/0059140 | A1 | 3/2007 | Kiser | |
| 2009/0016866 | A1 * | 1/2009 | Zaragoza et al. | 414/541 |

OTHER PUBLICATIONS

Braun UVL.

* cited by examiner

*Primary Examiner* — Saul Rodriguez
*Assistant Examiner* — Willie Berry, Jr.
(74) *Attorney, Agent, or Firm* — Charles J. Prescott

(57) ABSTRACT

A wheelchair lifting apparatus attachable beneath an undercarriage of a vehicle. The apparatus includes a frame positionable directly beneath and attachable to the undercarriage, a carriage slidably carried for horizontal movement on the frame lateral to the vehicle, and a lifting platform slidably carried on the frame in end-to-end proximity to the carriage for horizontal movement dependent upon movement of the carriage. An actuator is connected between the frame and the carriage and being operably arranged to effect movement of the carriage and the platform between the retracted and extended position of the platform. The frame and the actuator are cooperatively configured with the platform to lower and raise the platform while in the extended position with the wheelchair and user thereatop.

16 Claims, 19 Drawing Sheets

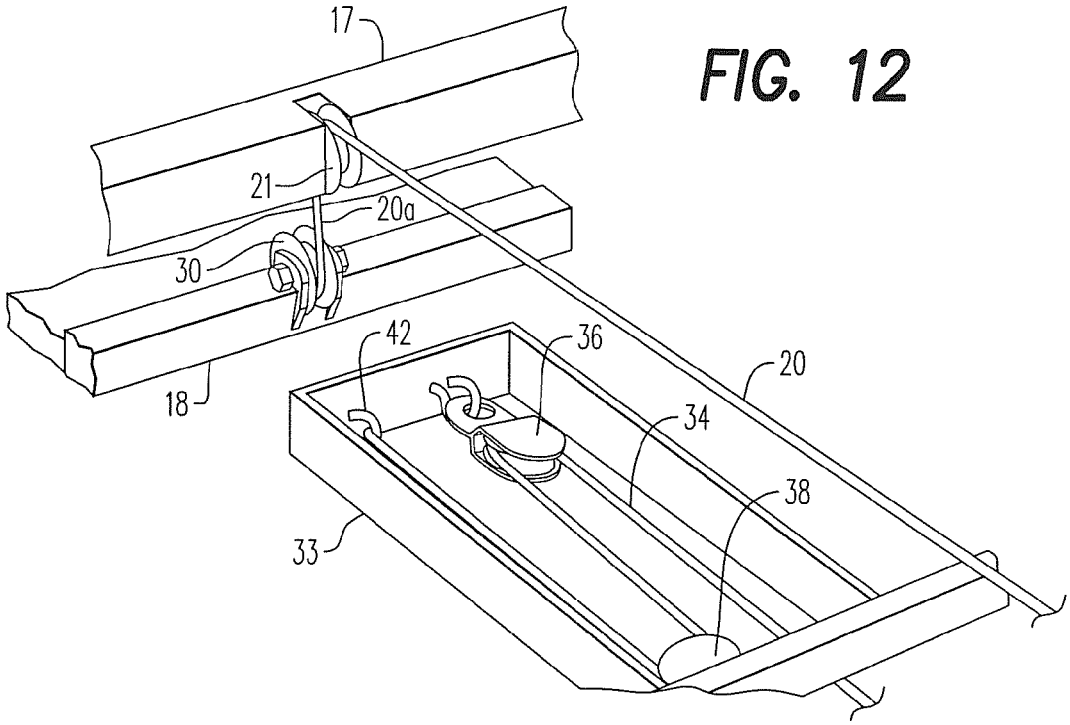
FIG. 12
FIG. 13
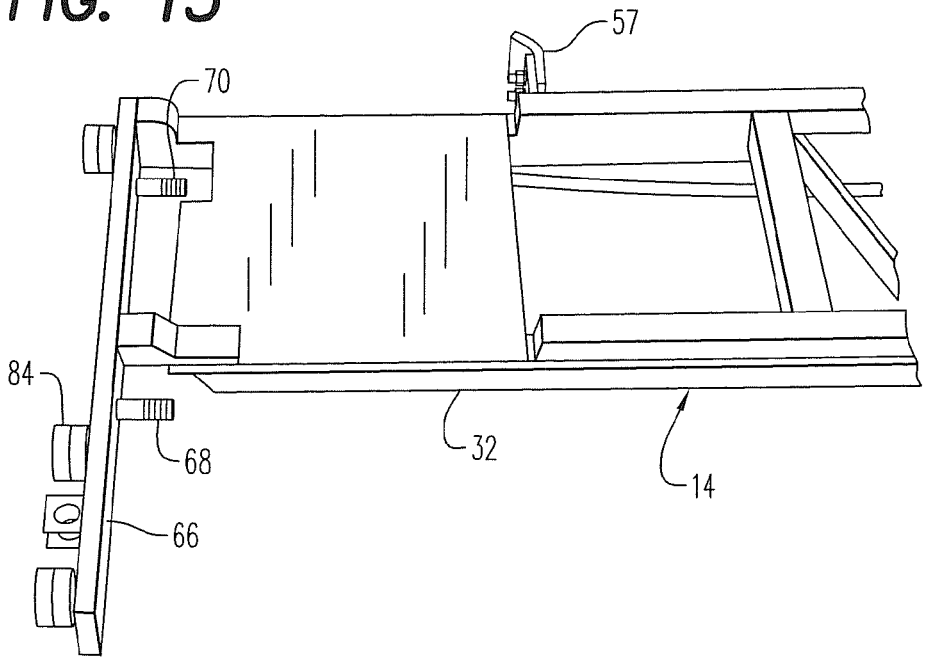

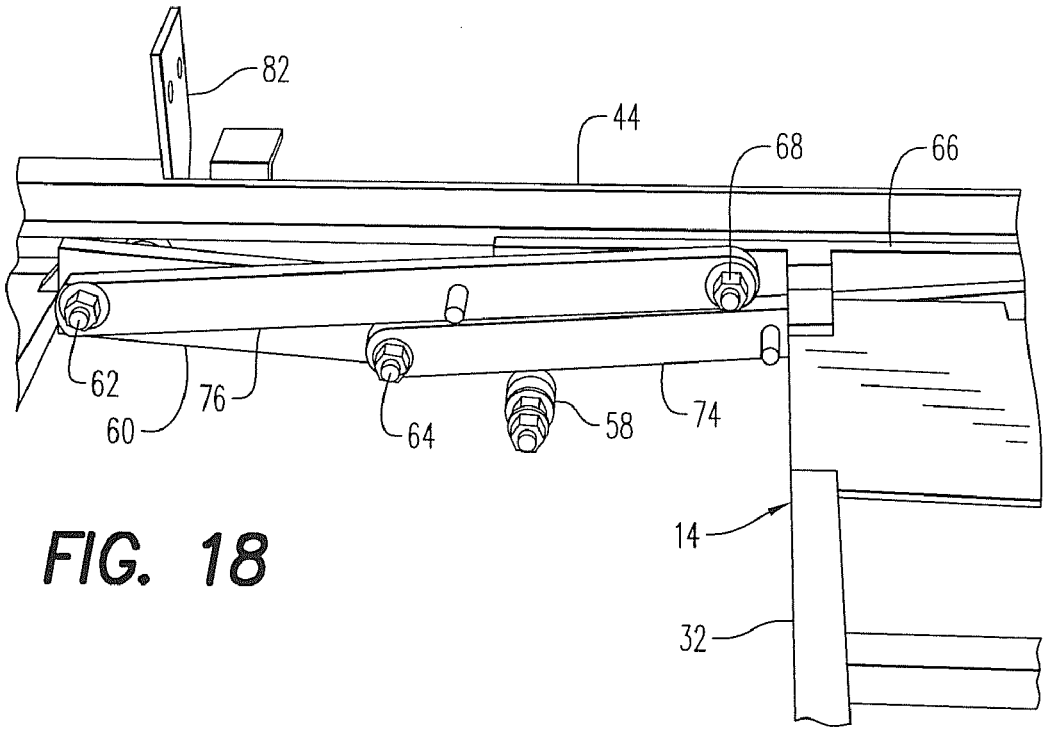
FIG. 18
FIG. 19
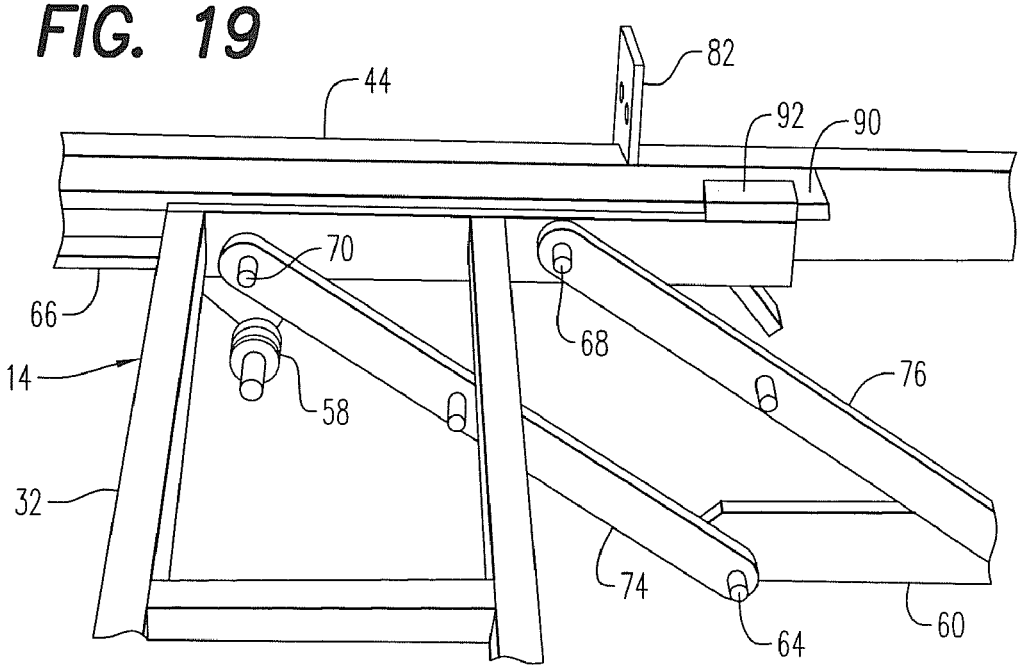

WHEELCHAIR LIFTING APPARATUS

CROSS-REFERENCE TO RELATED APPLICATIONS

Not applicable

STATEMENT REGARDING FEDERALLY SPONSORED RESEARCH OR DEVELOPMENT

Not applicable

INCORPORATION-BY-REFERENCE OF MATERIAL SUBMITTED ON A COMPACT DISC

Not applicable

BACKGROUND OF THE INVENTION

1. Field of the Invention

This invention relates generally to mobility access devices, and more particularly to a wheelchair lifting apparatus attachable beneath the floor or frame structure of a vehicle for assisting a wheelchair user in entering and exiting the vehicle.

2. Description of Related Art

Ramp access for wheelchair confined drivers and passengers are well known which facilitate a physically challenged wheelchair user in accessing into and exiting from a vehicle such as a van without the need for manual assist. Ramp access is typically facilitated from either the side or the rear of the vehicle and various mechanisms have been provided to extend and retract the ramp on demand.

One such device invented by Navarro and assigned to The Braun Corporation teaches an access system for passenger boarding into the side opening of a van as facilitated by a unique drive mechanism for pivotally deploying and retracting the ramp. The Braun Corporation owns another pending application invented by Kiser which teaches a linear drive system for reversibly operating a wheelchair ramp as facilitated by another unique drive apparatus.

The present invention teaches a vertically movable platform rather than a pivotally deployable ramp, the platform being supported by and within a frame connectable beneath the floor or undercarriage of a vehicle such as a van. The platform is movable horizontally within the frame and is laterally extendable from the vehicle beneath a side opening of the vehicle and then, with a single actuator, vertically moves the platform downwardly to the ground for wheelchair loading. Thereafter, the single drive mechanism which may be either a cable winch or a hydraulic actuator, may be actuated to lift the platform for loading the wheelchair into the vehicle and then is retracted beneath the vehicle into the frame. Very little, if any, modification to the vehicle itself is required where convenient attachment to the frame is accessible beneath a vehicle door.

The foregoing examples of the related art and limitations related therewith are intended to be illustrative and not exclusive. Other limitations of the related art will become apparent to those skilled in the art upon a reading of the specification and a study of the drawings.

BRIEF SUMMARY OF THE INVENTION

This invention is directed to a wheelchair lifting apparatus attachable beneath an undercarriage of a vehicle. The apparatus includes a frame positionable directly beneath and attachable to the undercarriage, an intermediate carriage slidably carried for horizontal movement on the frame, and a lifting platform slidably carried on the frame in end-to-end proximity to the carriage for horizontal movement dependent upon movement of the carriage. An actuator is connected between the frame and the carriage and is operably arranged to effect lateral or horizontal movement of the carriage and the platform between the retracted and extended position of the platform. The frame and the actuator are cooperatively configured with the platform to also lower and raise the platform while in the extended position.

It is therefore an object of this invention to provide a wheelchair lifting apparatus which is attachable beneath the floor or undercarriage of a vehicle and which facilitates easy loading and unloading of a wheelchair confined person as they remain seated in the wheelchair.

Another object of this invention is to provide a lifting apparatus which is easily attachable beneath the floor or undercarriage of a vehicle without substantial vehicle modification.

Still another object of this invention is to provide a wheelchair lifting apparatus which facilitates ingress and egress of a wheelchair confined person without the need for personal assistance in getting into and out of the vehicle and without the need for the utilization of a power wheelchair to negotiate the rather steep ramp conditions of such conventional apparatus.

Yet another object of this invention is to provide a wheelchair lifting apparatus for vehicles such as vans which utilizes only a single actuator to accomplish the deployment and raising and lowering of a lifting platform for wheelchairs.

And yet another object of this invention is to provide a wheelchair lifting apparatus which may also include a secondary lifting stage of the lifting platform which will elevate a wheelchair up to the height of the floor of the vehicle.

The following embodiments and aspects thereof are described and illustrated in conjunction with systems, tools and methods which are meant to be exemplary and illustrative and not limiting in scope. In various embodiments one or more of the above-described problems have been reduced or eliminated while other embodiments are directed to other improvements. In addition to the exemplary aspects and embodiments described above, further aspects and embodiments will become apparent by reference to the drawings and by study of the following descriptions.

BRIEF DESCRIPTION OF THE SEVERAL VIEWS OF THE DRAWING(S)

Figure 1:
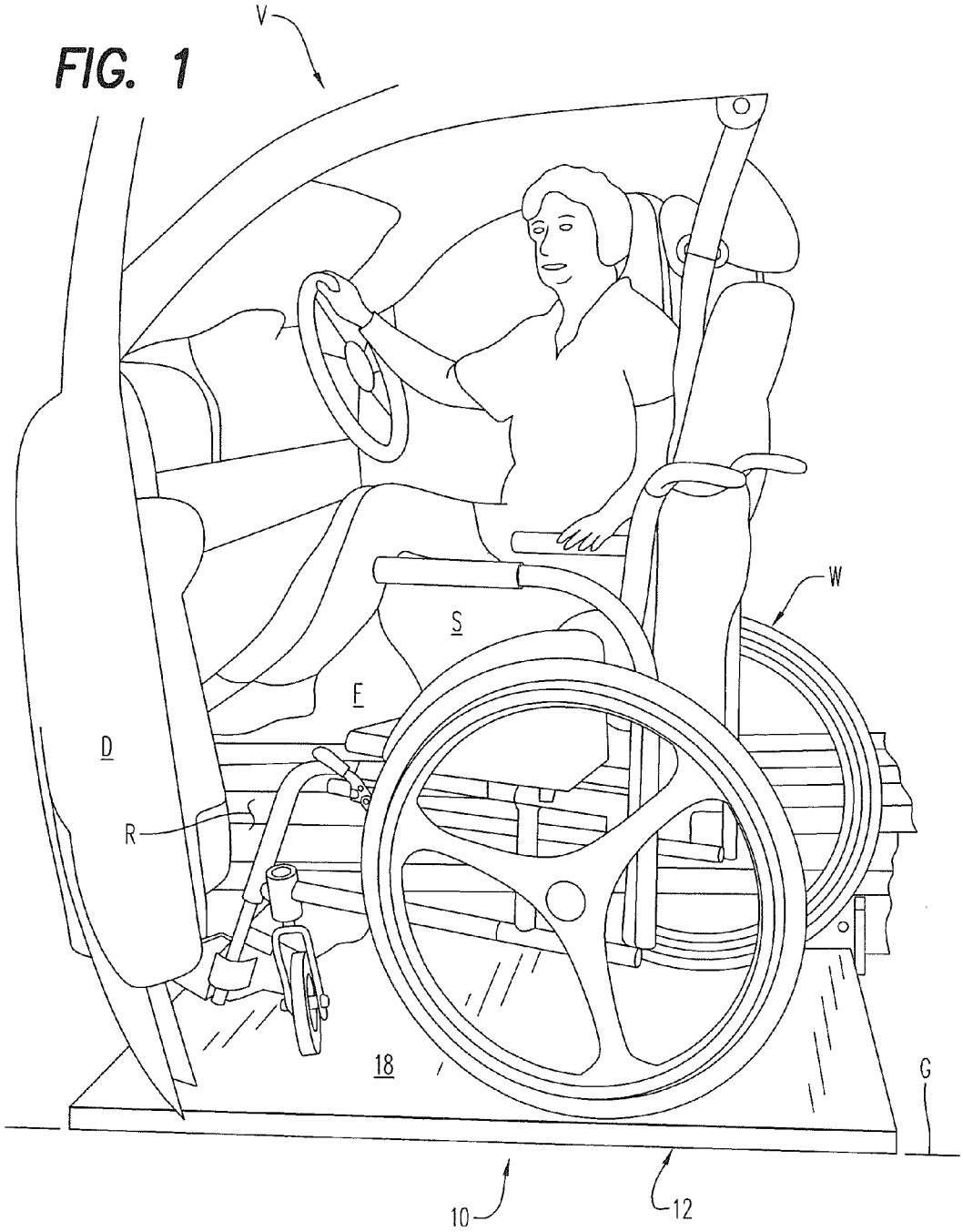
FIG. 1 is a pictorial view of one embodiment of the invention attached to a vehicle and in use.
Figure 3A:
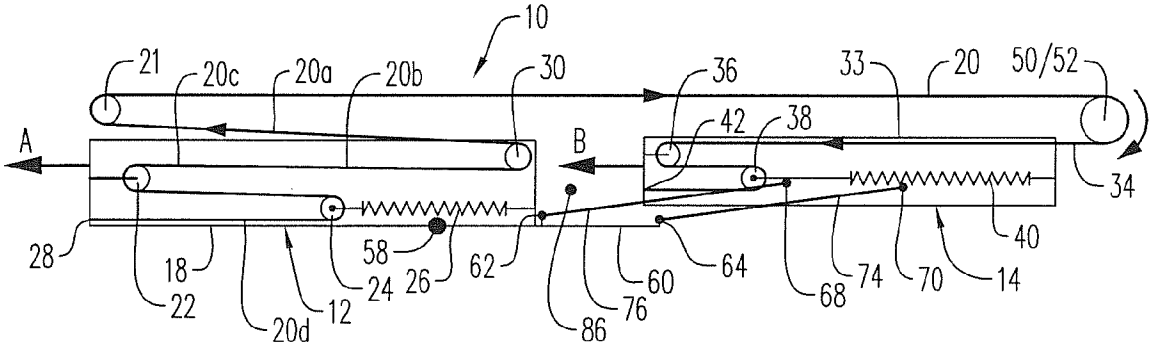

FIGS. 3A, B and C are schematic end elevation views which depict sequential schematic views of the deployment of the lifting platform of the apparatus in FIG. 1.

Figure 4:
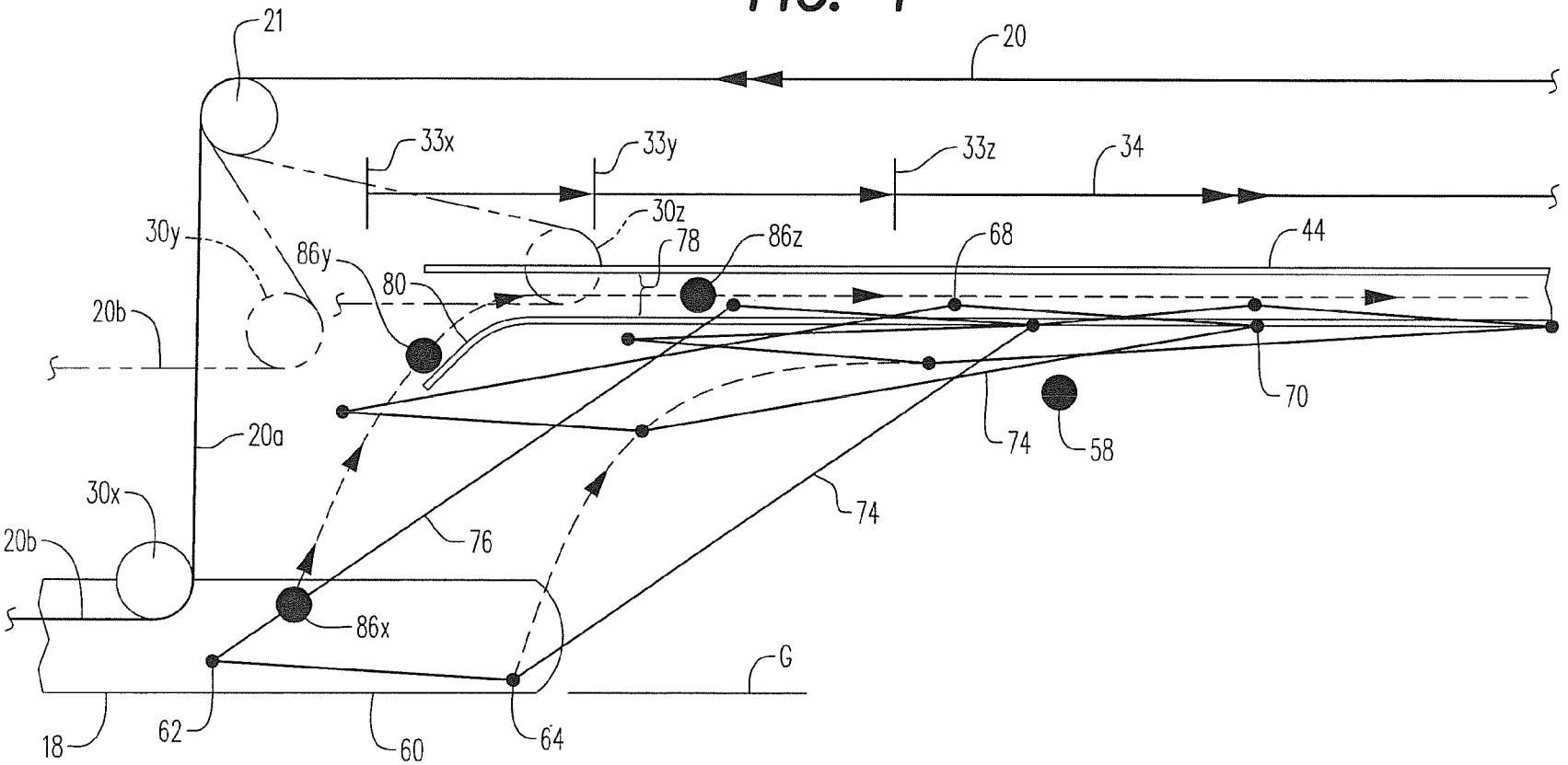

FIG. 4 is an enlarged schematic view of the portion of the apparatus of FIG. 1 which facilitates the vertical deployment of the lifting platform.

Figure 5:
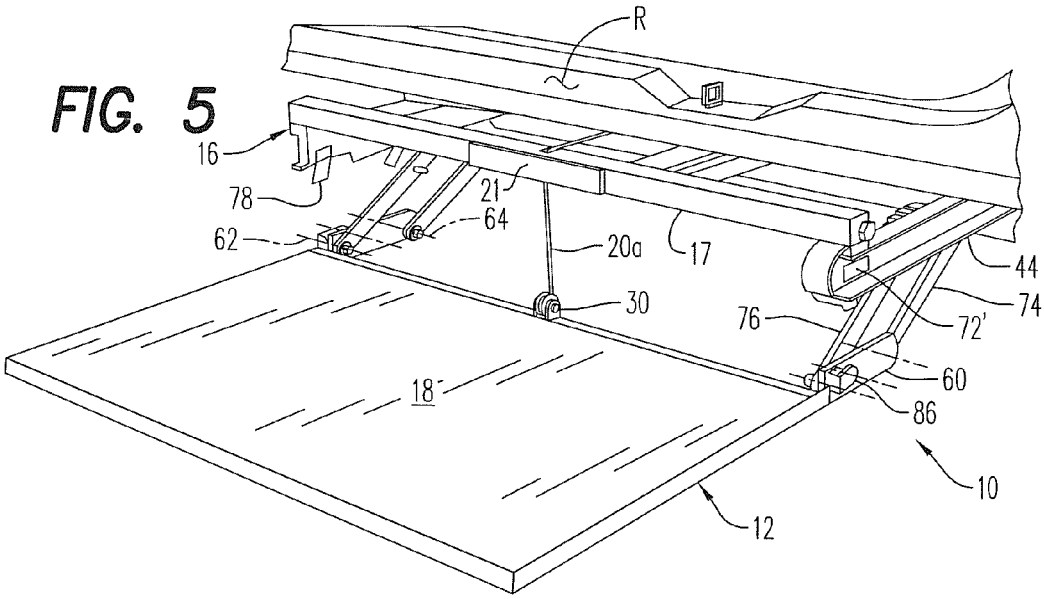

FIG. 5 is a perspective view of the invention of FIG. 1 in the deployed and downward positioning of the lifting platform.

Figure 6:
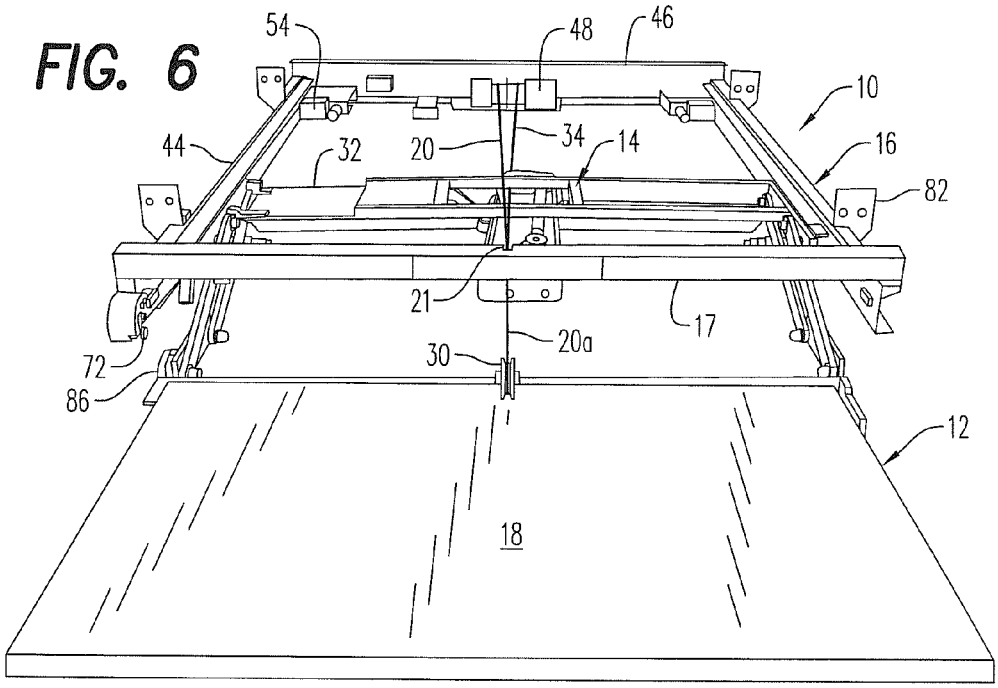

FIG. 6 is a side perspective view of FIG. 5.

Figure 7:
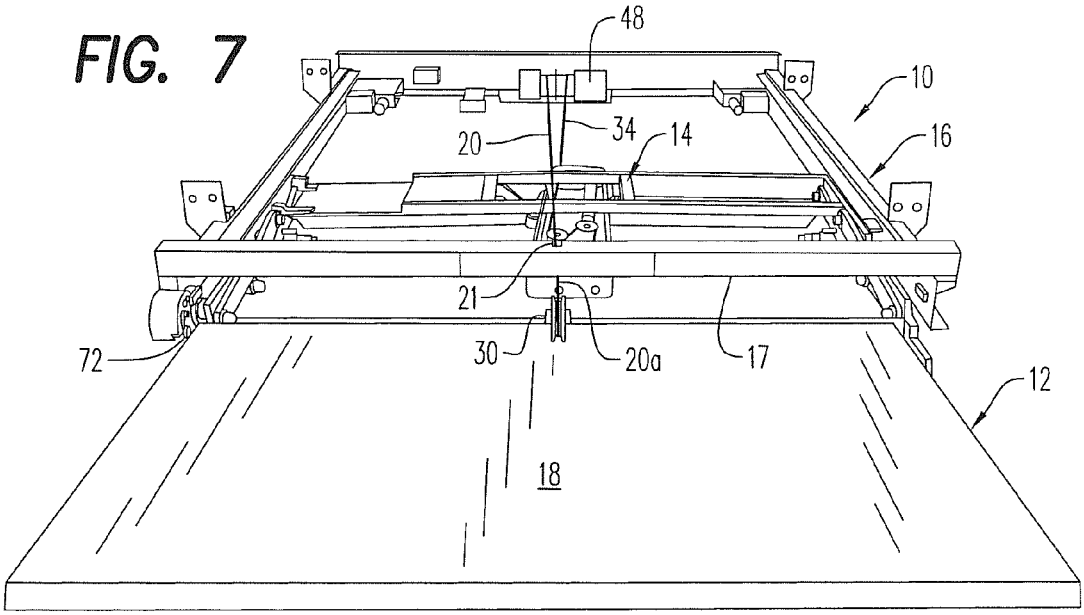

FIG. 7 is a view similar to FIG. 6 with the lifting platform in the upper position.

Figure 8:
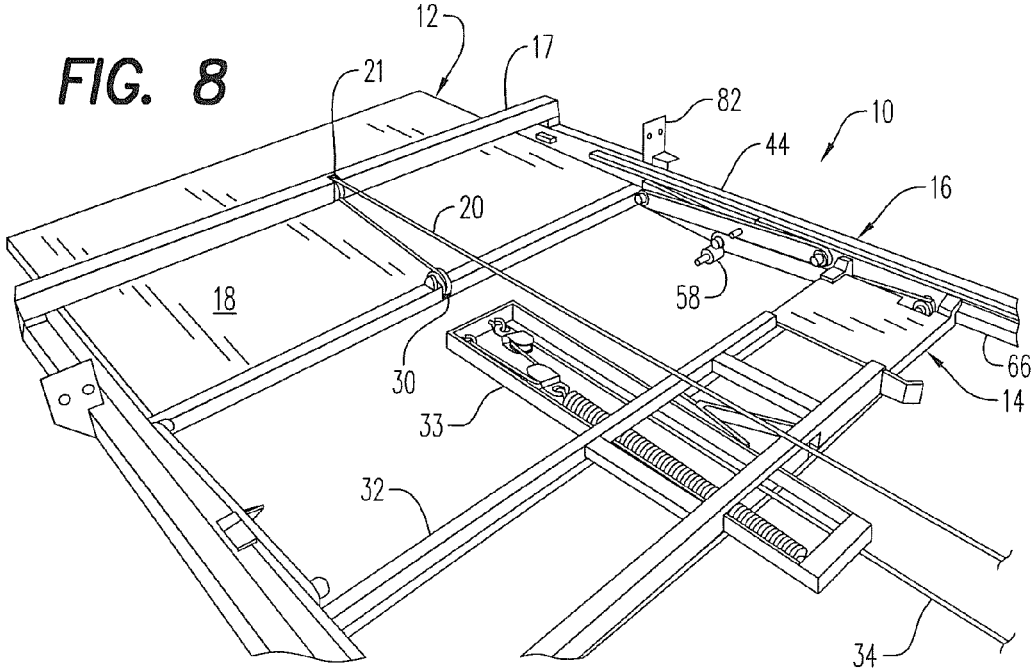

FIG. 8 is a perspective view of the apparatus of FIG. 1 in a partially deployed position.

Figure 9:
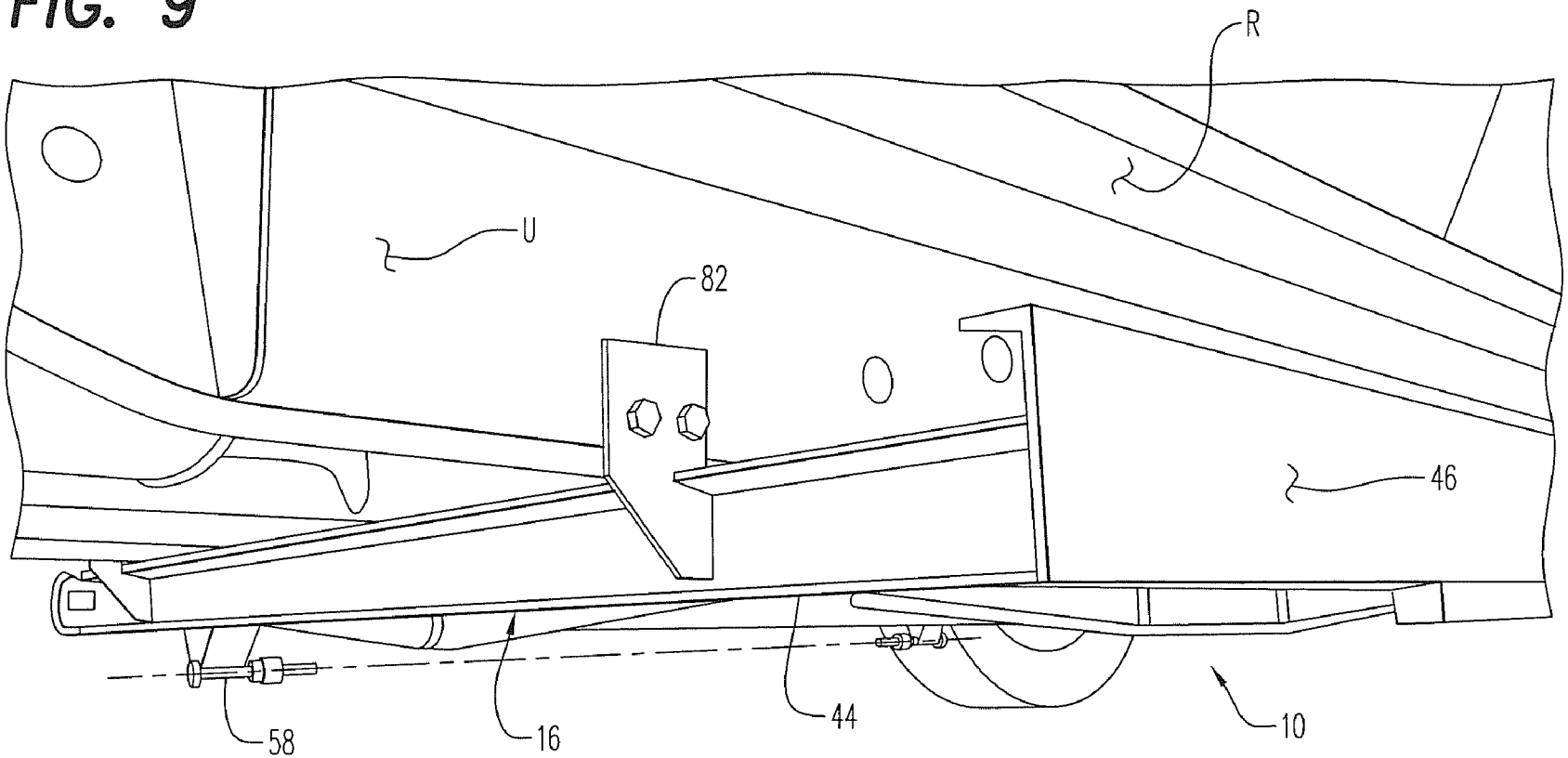

FIG. 9 is a perspective view of the opposite side of the vehicle and apparatus of FIG. 1.

Figure 10:
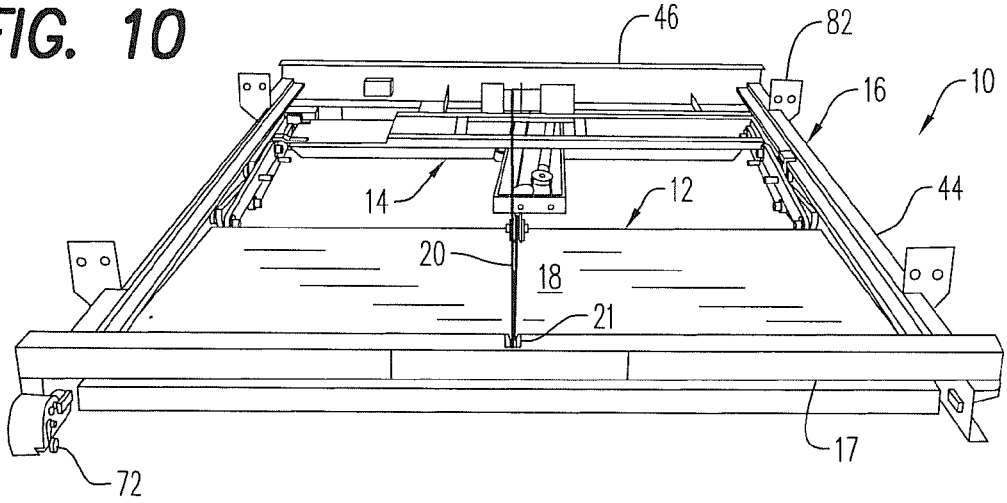

FIG. 10 is a side perspective view of the apparatus of FIG. 1 in the retracted, stored position.

Figure 11:
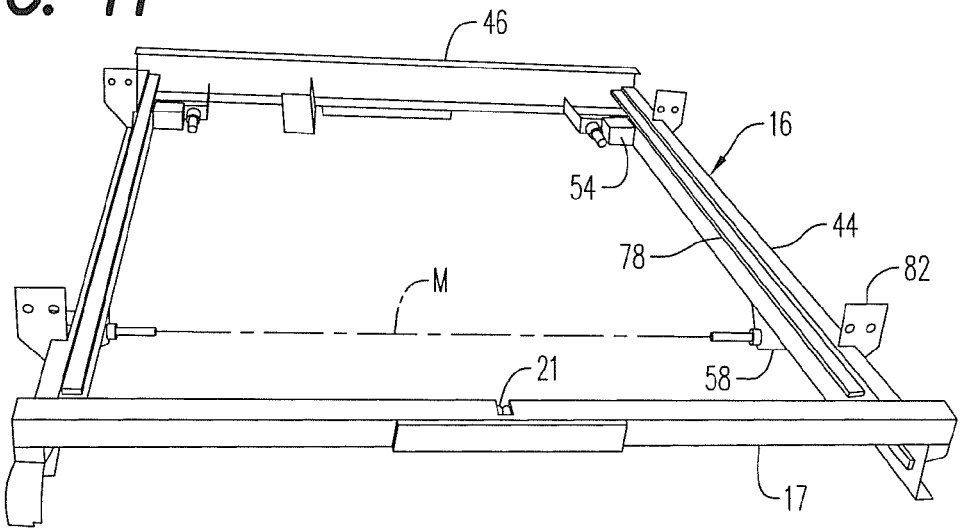

FIG. 11 is a side perspective view of the frame assembly of FIG. 1.

FIG. 12 is an enlarged perspective view of a central portion of the frame, lifting platform, and intermediate carriage of FIG. 1.

FIG. 13 is a perspective view of one side or half of the intermediate carriage of FIG. 1.

Figure 14:
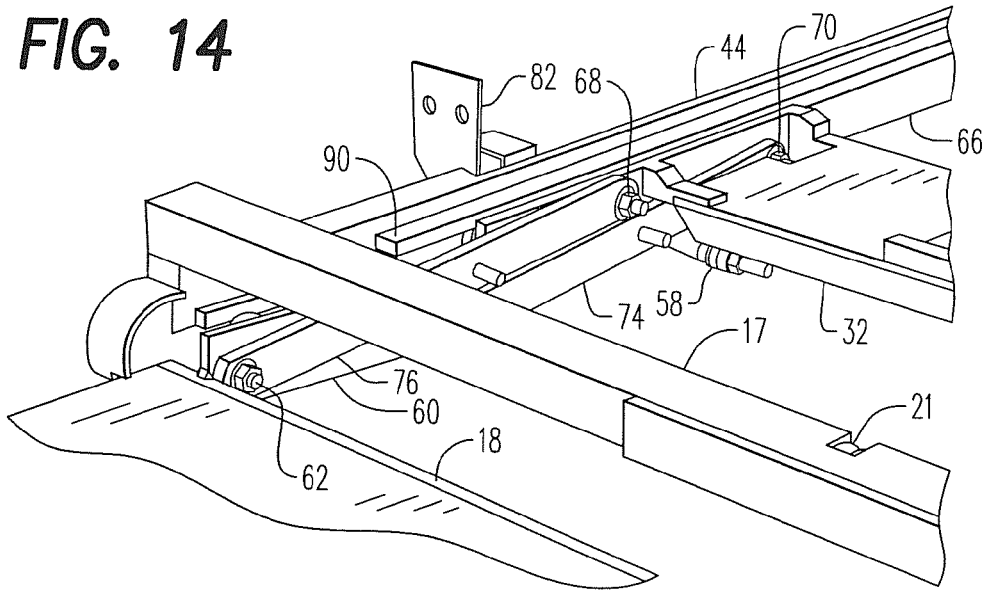

FIG. 14 is a perspective view of the forwardly corner of the apparatus of FIG. 1.

Figure 15:
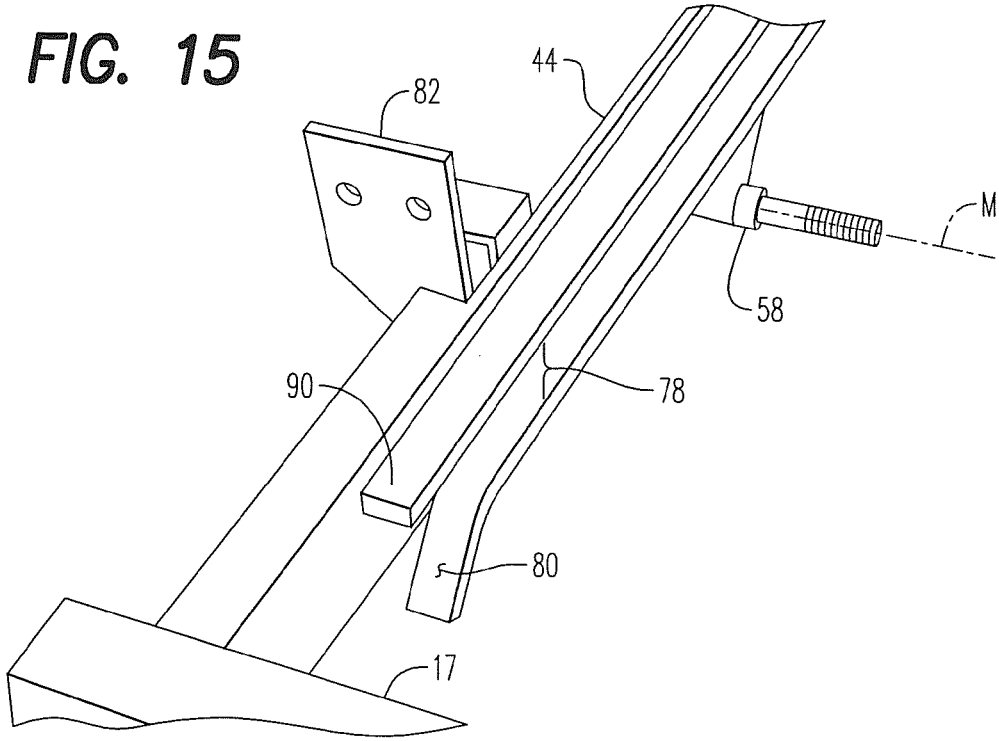

FIG. 15 is an enlarged view of the corner of the frame of FIG. 14.

Figure 16:
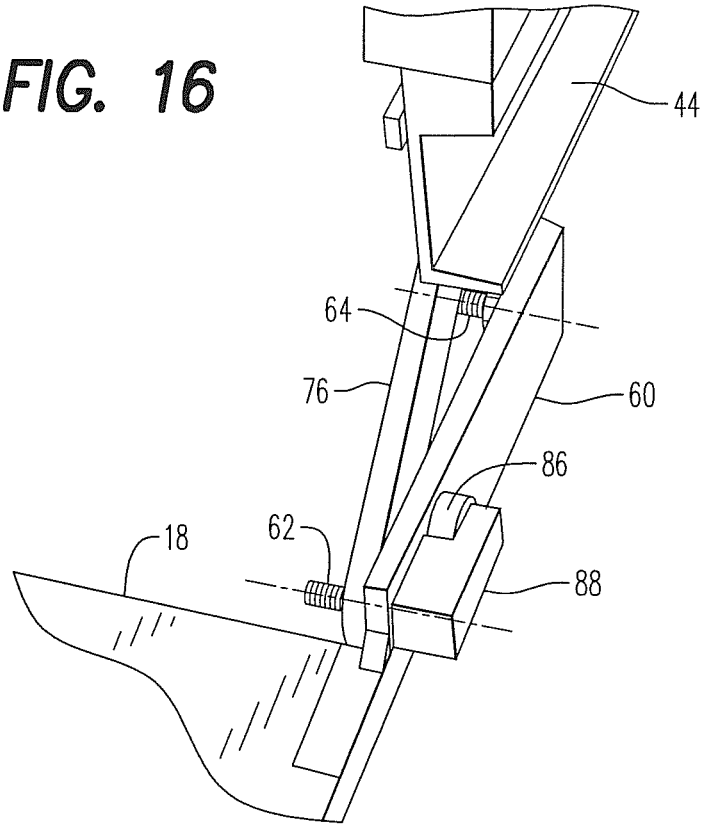

FIG. 16 is an enlarged view of a rear corner of the lifting platform and frame of FIG. 1.

Figure 17:
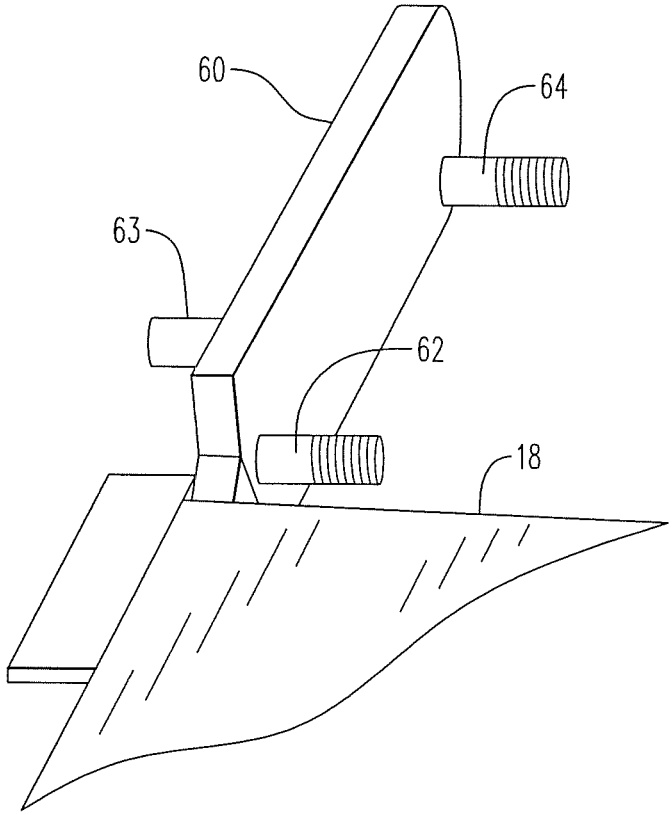

FIG. 17 is an enlarged perspective view of the forward corner of the lifting platform of FIG. 1.

FIG. 18 is an inside perspective view of the side portion of the intermediate carriage, frame and parallel linkage between the carriage and the platform of FIG. 1.

FIG. 19 is a perspective view similar to that of FIG. 18 showing the lifting platform in the extended downwardly position.

Figure 20:
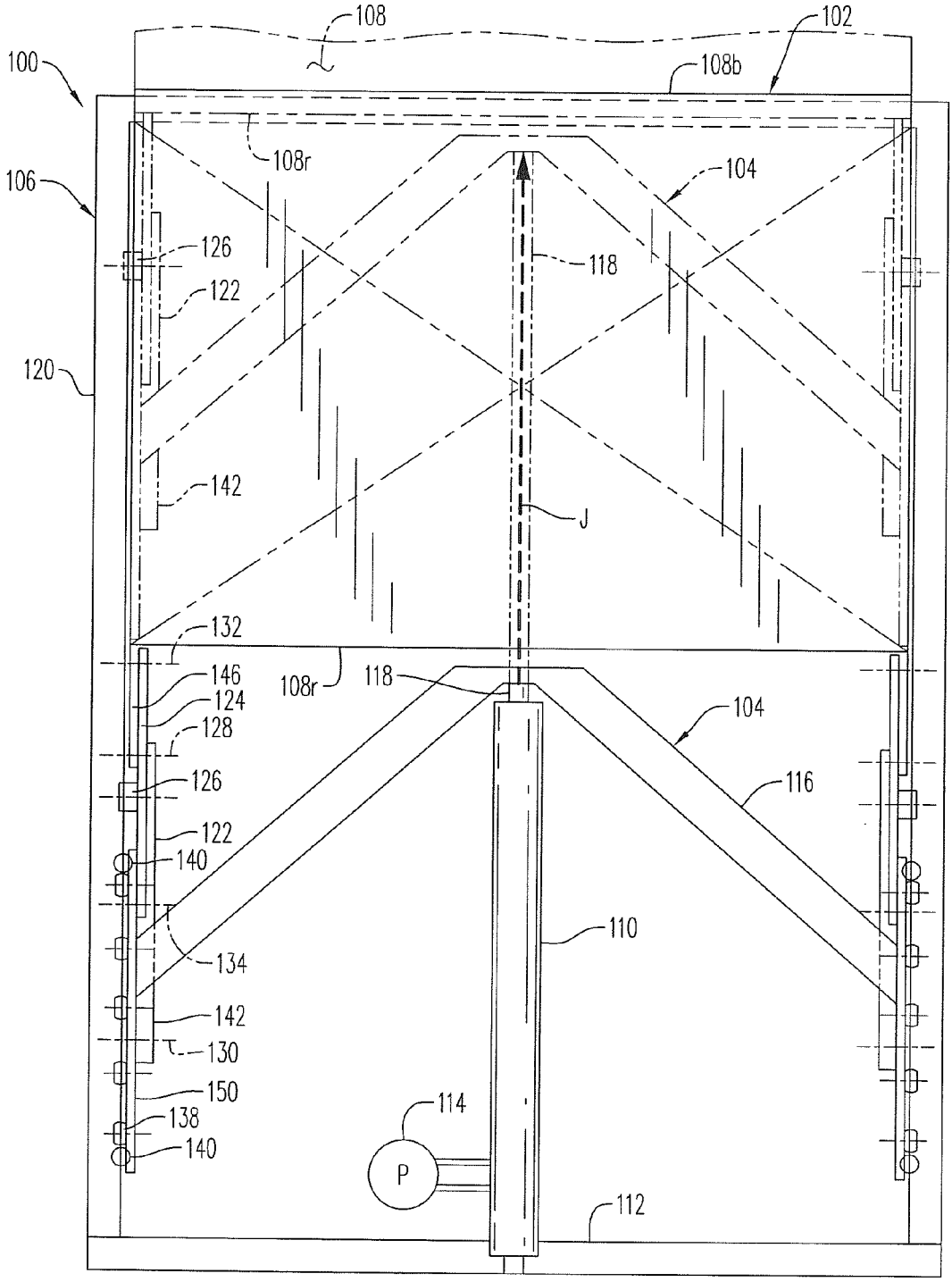

FIG. 20 is a simplified top plan view of another embodiment of the invention using a single linear actuator.

Figure 21:
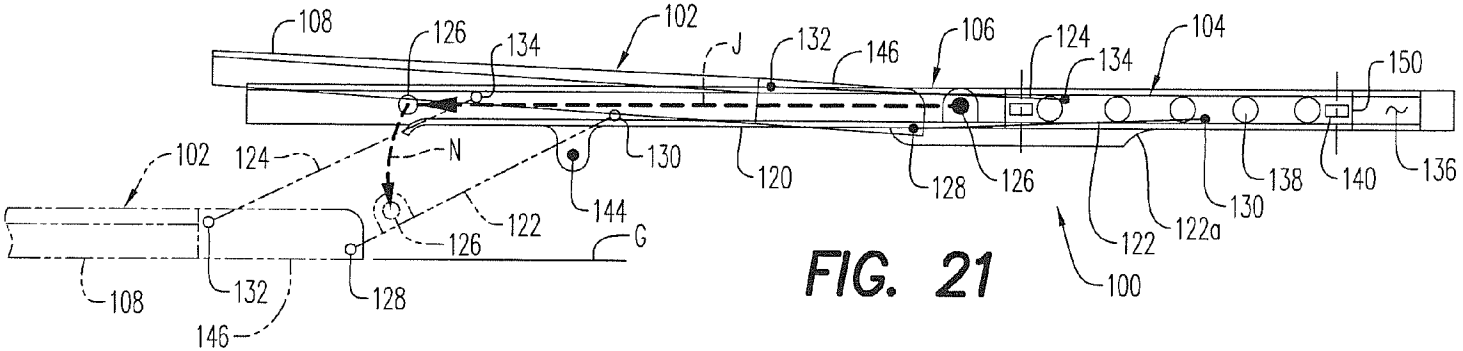

FIG. 21 is a simplified side elevation view of FIG. 20 depicting the deployment of the lifting platform.

Figure 22:
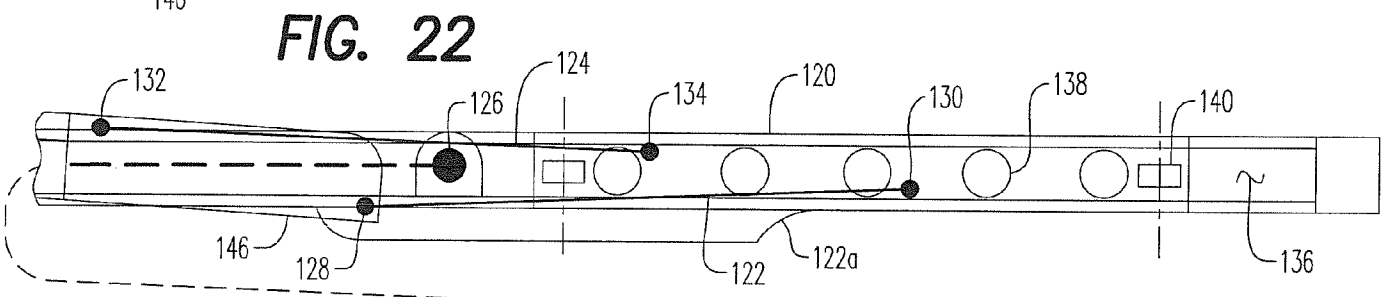

FIG. 22 is an enlargement of a portion of FIG. 21.

Figure 23:
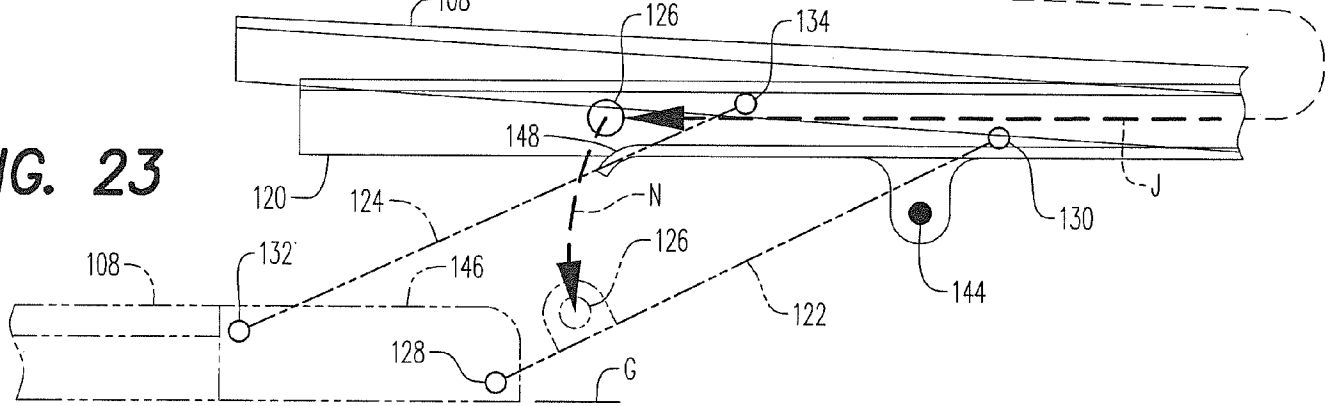

FIG. 23 is a continuation of FIG. 22.

Figure 24:
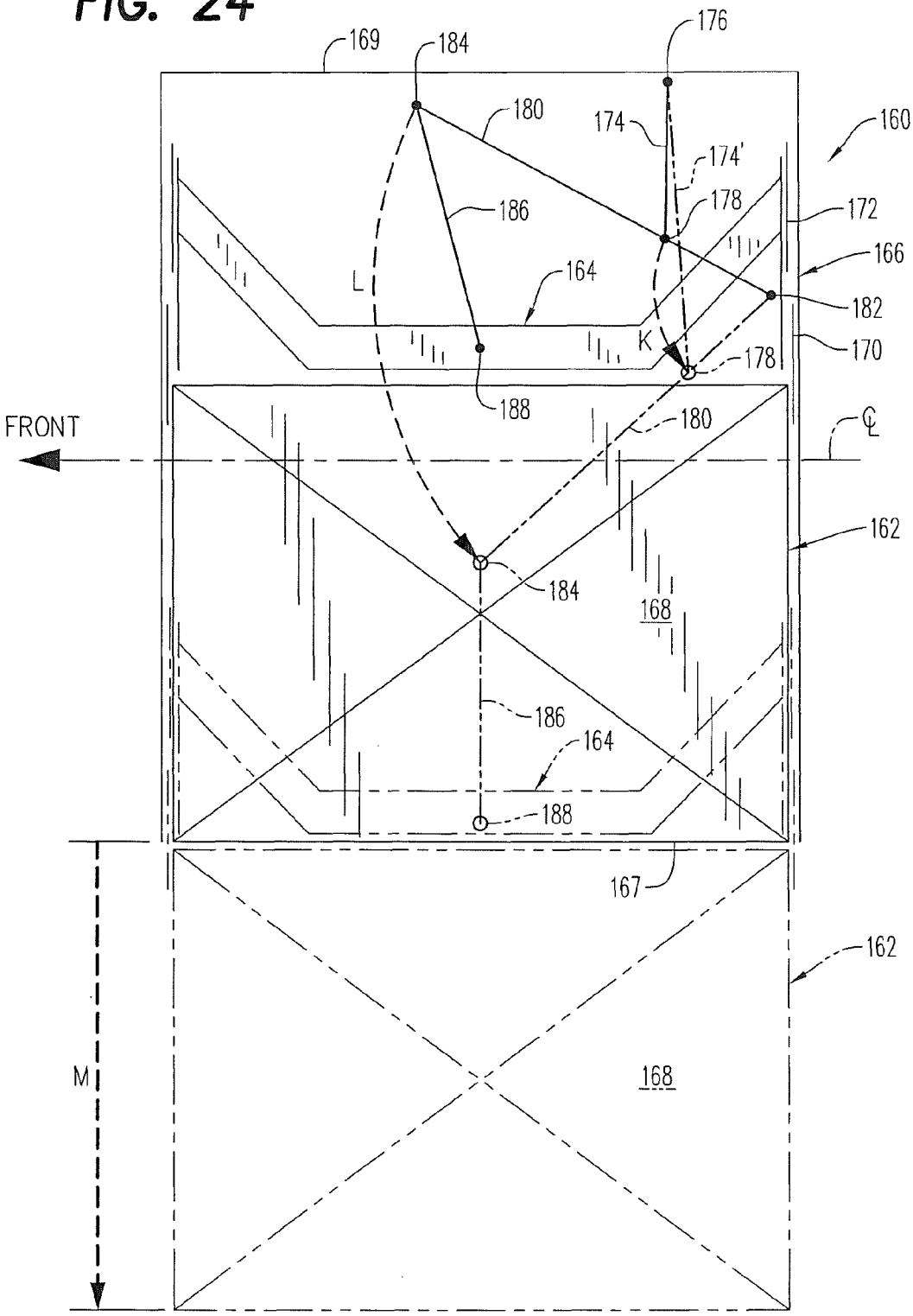

FIG. 24 is a simplified schematic view of a second alternate embodiment utilizing a single hydraulic actuator and displacement multiplication for compactness.

Figure 25:
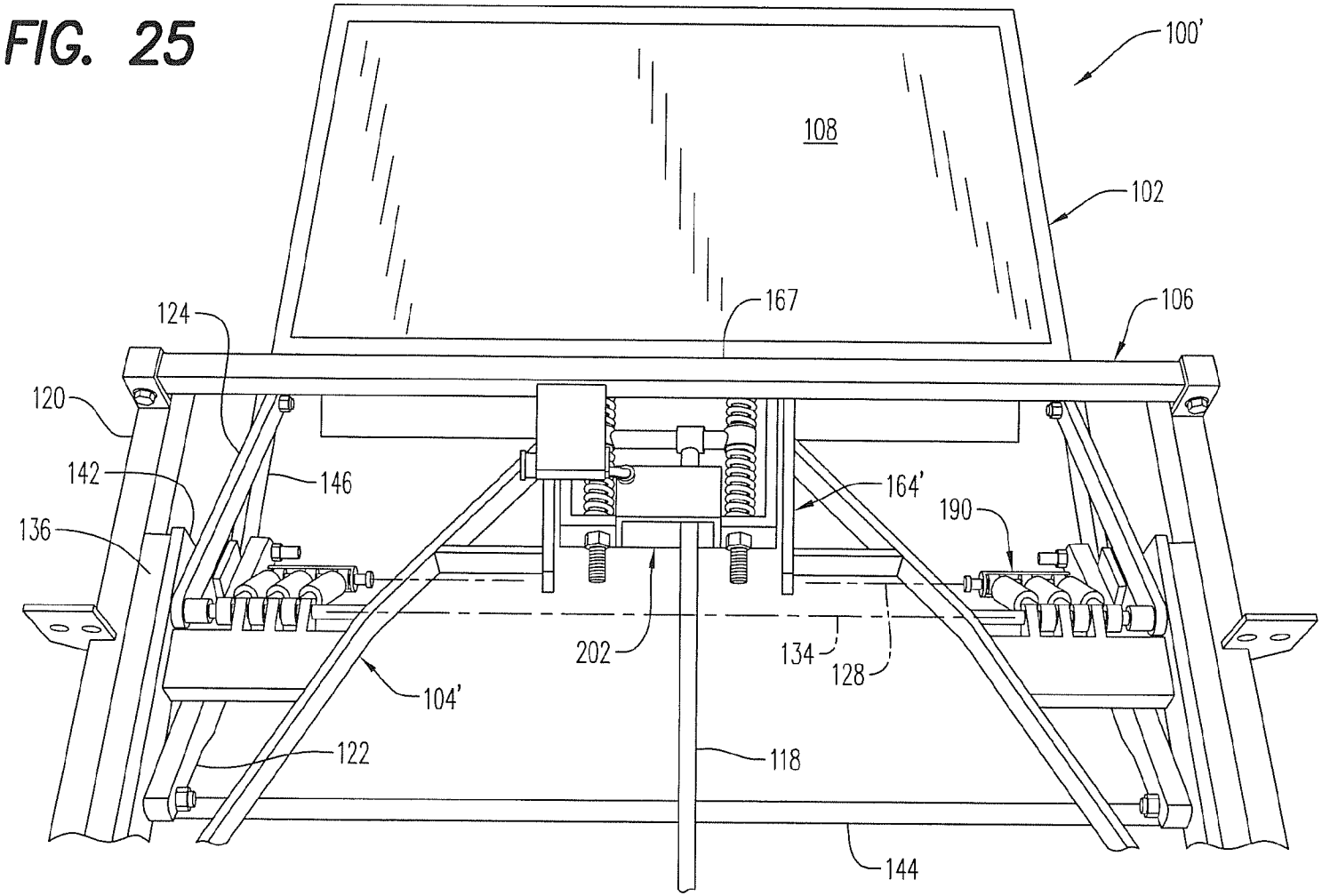

FIG. 25 is a perspective view of one half of an alternate embodiment of FIG. 20 showing the lifting platform deployed in the downward position.

Figure 26:
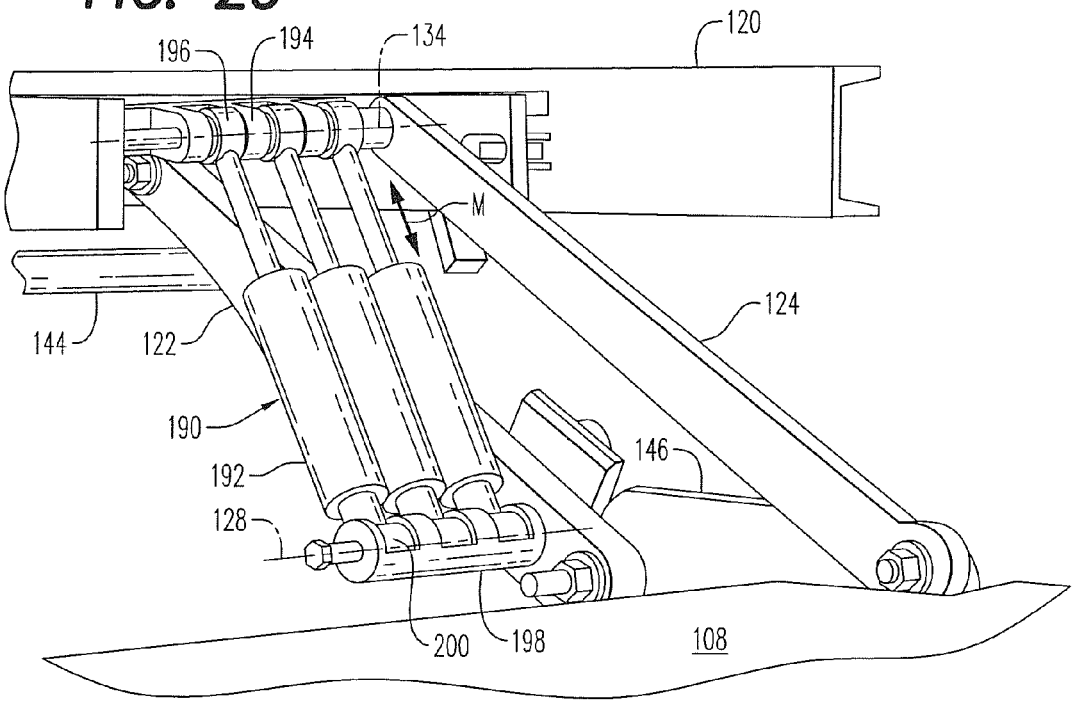

FIG. 26 is an enlarged perspective view of the parallel linkage and hydraulic damping mechanism of FIG. 25.

Figure 27:
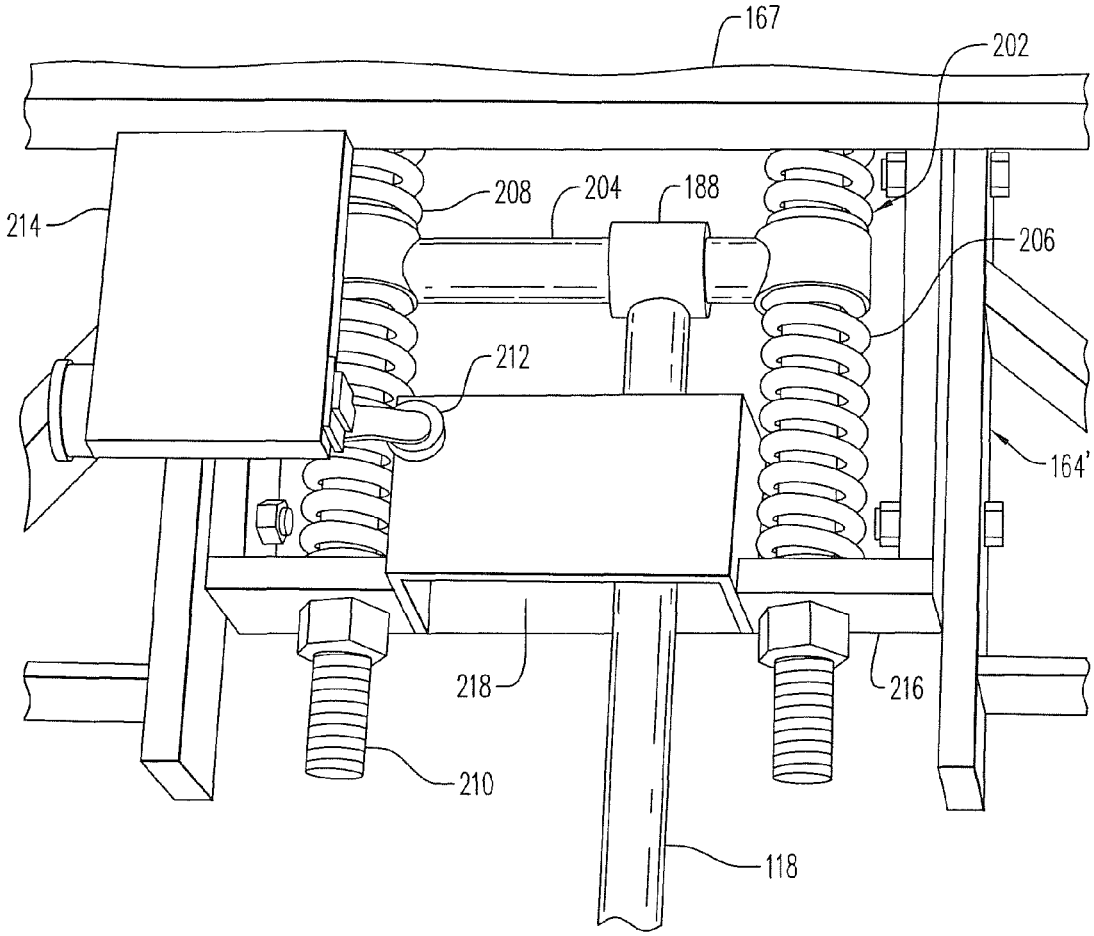

FIG. 27 is a perspective top view of the connection between the linear actuator and carriage of FIG. 25.

Figure 28:
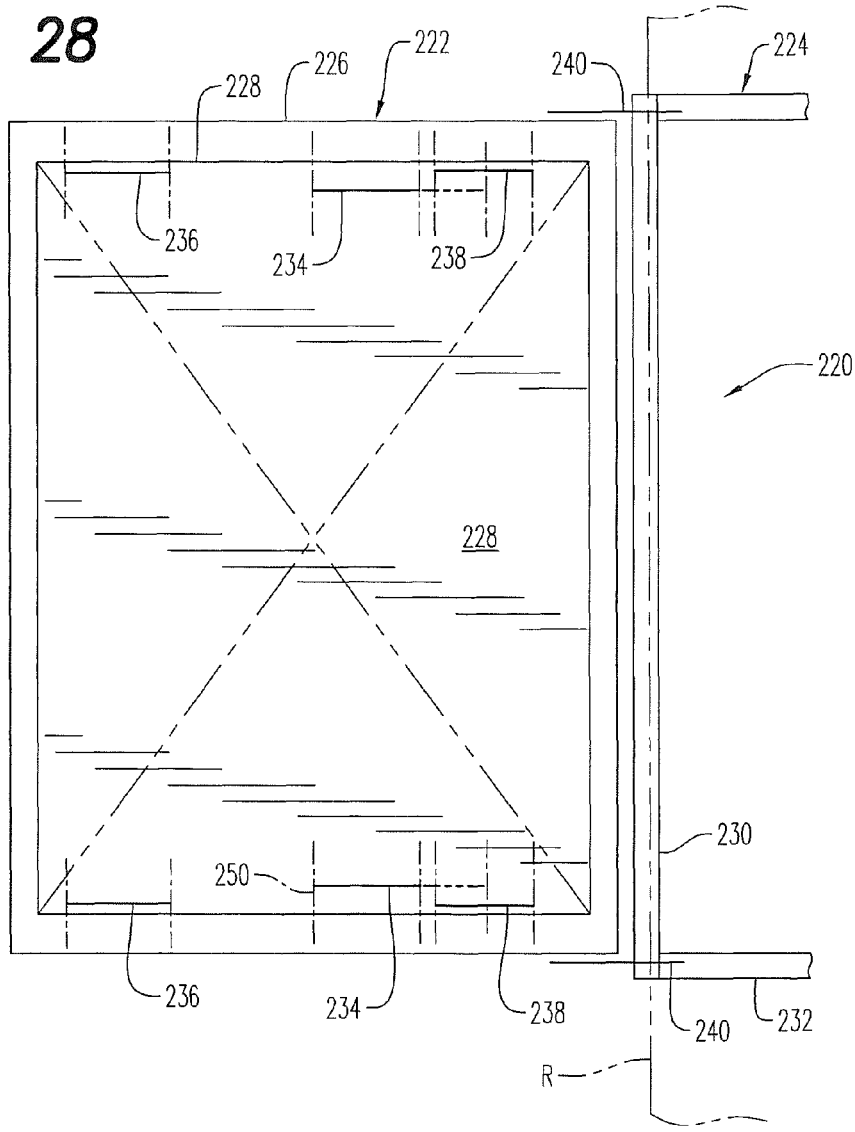

FIG. 28 is a top plan view a third alternate embodiment of the lifting platform depicting a second lifting stage therefor.

Figure 29:
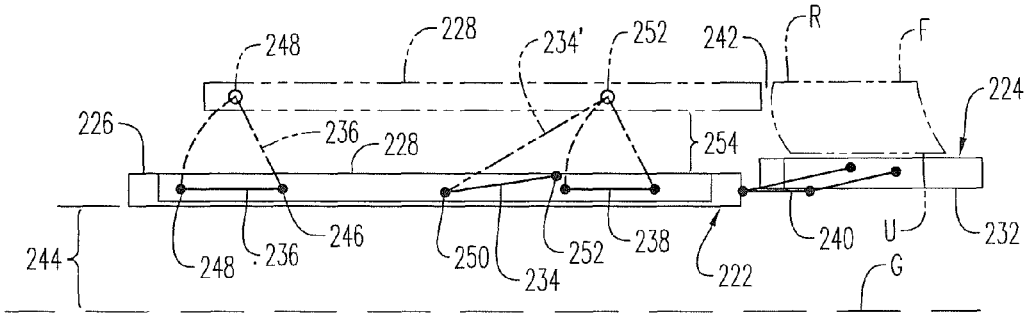

FIG. 29 is an end elevation view of FIG. 28.

Exemplary embodiments are illustrated in reference figures of the drawings. It is intended that the embodiments and figures disclosed herein are to be considered to be illustrative rather than limiting.

DETAILED DESCRIPTION OF THE INVENTION

Overview

Referring now to the drawings, and firstly to FIGS. 1 to 19, a first embodiment of the invention is there shown generally at numeral 10 and includes a lifting platform assembly 12, an intermediate carriage assembly 14, and a frame assembly 16. As best seen in FIGS. 1, 5 and 9, the frame assembly 16 is attachable as described herebelow beneath the floor F and undercarriage U of the vehicle V shown in FIG. 1.

As best seen in FIG. 1, when the lifting platform assembly 12 is deployed, the platform 18 extends laterally or sideways, then downward from the side of the vehicle V. The apparatus 10, in this installation embodiment, is installed beneath the driver's seat to facilitate the manual transfer of the person from the wheelchair W into the driver's seat S with the vehicle door D open by the lifting of the wheelchair W upwardly from the ground G or other vehicle support surface approximately ten (10) inches so that the seating surface of the wheelchair W is almost on an equal level with the seat support surface of the driver's seat S. However, in this embodiment 10, the depth of the undercarriage U below the rocker panel R and floor F are together, greater than the height of the wheelchair seat, leaving a slight elevational transfer to be made by the user.

The procedure is reversed when the person wishes to exit the vehicle whereupon the platform 18 is laterally deployed as will be described more fully herebelow laterally outwardly from the side of the vehicle V and held in the elevated position with the wheelchair W thereatop. The person may then easily transfer from the vehicle driver's seat S into the wheelchair W. Thereafter, the platform 18 is lowered to the ground which allows the person in the wheelchair to move from the platform 18 and away from the vehicle V.

Figure 2:
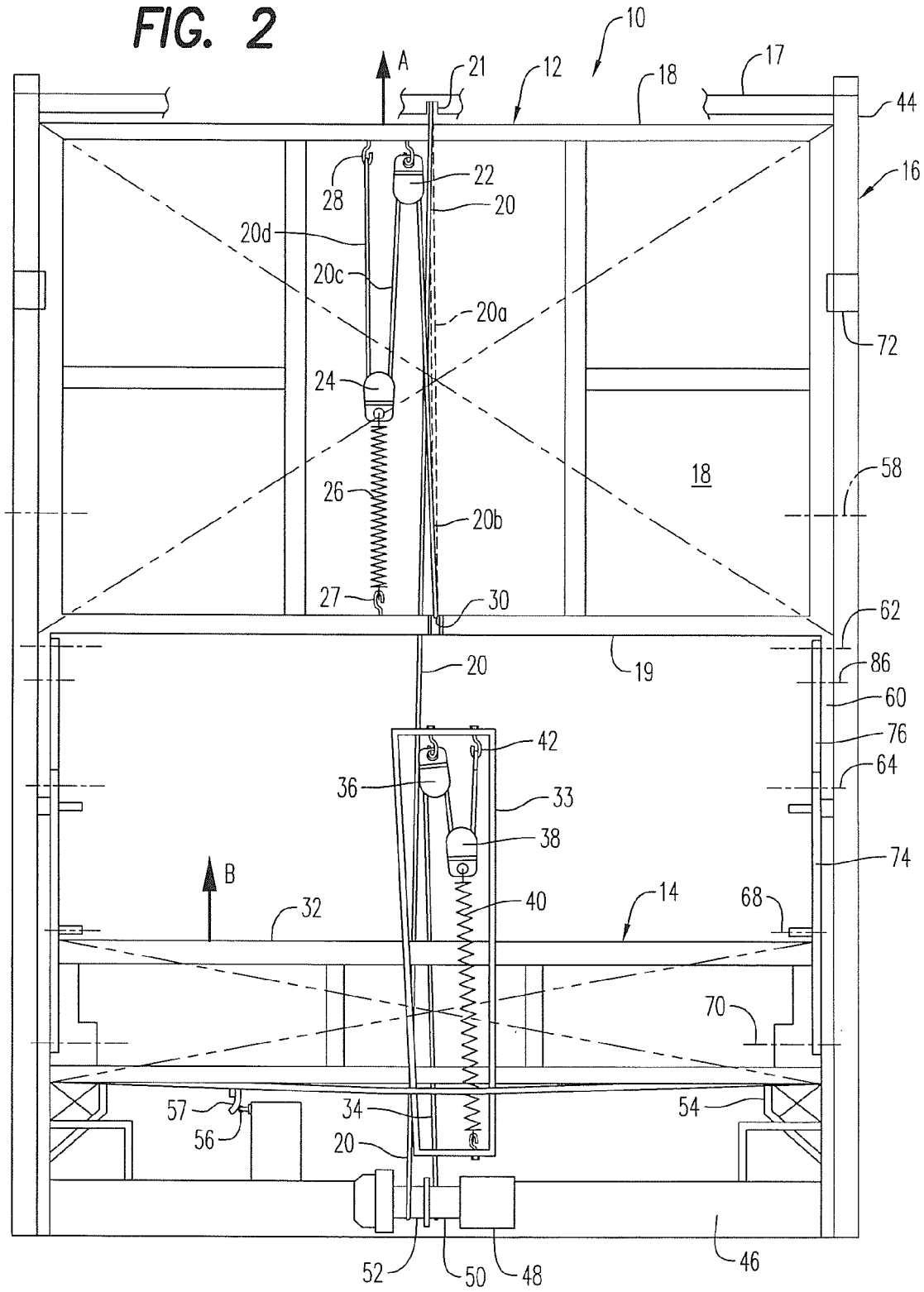
FIG. 2 is a broken bottom plan view of the wheelchair lifting apparatus of FIG. 1.

The lifting platform assembly 12 includes a flat preferably rectangular platform 18 formed of a sheet metal or plastic panel or from an expanded metal panel. A framework therebeneath having an overall thickness of approximately 1" as best seen in FIG. 2, provides sufficient strength and rigidity to lift a person in the wheelchair placed thereupon. Platform arms 60, as best seen in FIGS. 5, 16 and 17, are rigidly connected to each corner of the proximal corners of the platform 18 extending parallel to the forwardly and rearwardly margins thereof. These platform arms 60 include two spaced inwardly extending lower pivot pins 62 and 64 and an outwardly and oppositely extending guide roller support shaft 63. A roller 30 centrally connected along the inner longitudinal margin of the lifting platform assembly 12 is also provided, the purpose of which will be described herebelow.

The intermediate carriage assembly 14 is slidably or rollably connected between the frame side channels 44 of the frame assembly 16. The carriage assembly 14 includes a carriage frame 32 which extends transversely between the parallel side channels 44 and is supported within the C-section side channels 44 on roller bearings 84 best shown in FIG. 13. These rollers 84 are sized for close rollable engagement within the platform side guides 78 best seen in FIG. 15 to help prevent rattling.

The frame assembly 16 also includes end cross members 18 and 46 and four mounting brackets 82 provided for interconnection of the apparatus 10 to the undercarriage U. The carriage assembly 14 slidably rolls within the inwardly facing C-shaped platform side guides 78 of each of the side channels 44 on roller bearings 84 as does the platform assembly 12 on platform guide rollers 86, the carriage frame 32 and the platform 12 thus sit end-to-end within the frame side channels 44 and are dependently movable one to another therewithin.

This dependent movement between the platform assembly 12 and the carriage assembly 14 is accomplished through parallel upper and lower control arms 76 and 74 connected between the lower pivot pins 62 and 64 on each of the platform arms 60 and the upper pivot pins 68 and 70 connected to the carriage side frame 66 at 68 and 70 as best seen in FIGS. 14 and 19. Thus, when both the lifting platform assembly 12 and the carriage assembly 14 are fully within the side guides 78 of the side channels 44, the rigid upper and lower control arms 76 and 74 result in uniform horizontal translation of both assemblies 12 and 14 in end-to-end proximity together.

As best seen in FIGS. 9 and 10, the lifting apparatus 10 is held by threaded fasteners connected through the four mounting brackets 82 to the undercarriage U which, in this vehicle V embodiment, is the frame of the vehicle V. By this mounting arrangement, substantially little, if any, modification to the undercarriage U of the vehicle V is required and easy disassembly for maintenance and repair of the apparatus 10 is effected.

Cable Actuator

The actuator mechanism for this embodiment 10 is in the form of a single reversible 124 cable winch actuator 48 which is mounted on the frame end cross member 46. Two separate side-by-side cable spools 50 and 52, are provided on the output shaft of the actuator 48, spool 50 including a carriage cable 34 while spool 52 includes an oppositely wrapped main cable 20. These oppositely wrapped cables 20 and 34 are provided so that, when the cable winch actuator 48 is operated, the cables 20 and 34 either retract or extend oppositely one from another.

As best seen in FIGS. 2, 7, 8 and 12, the main cable 20 extends from the main cable spool 52 to a platform support roller 21 connected, as best seen in FIG. 12, into a frame cross member 17 positioned centrally along the length thereof. The main cable 20 then extends at 20*a* to the roller 30 connected to the proximal side edge of the platform 18. The interaction between these rollers 21 and 30 by main cable portion 20*a* effect the lifting and lowering of the platform assembly 12 as will be more fully described herebelow.

The carriage cable 34 extends from the carriage cable spool 50 to a central take-up frame 33 of the carriage assembly 14 into pulley 36 which is anchored at the distal end of take-up frame 33 as best seen in FIG. 2. This carriage cable 34 has a primary function, that being to pull the carriage assembly 14 and the linkage-connected lifting platform assembly 12 from an extended position shown in FIGS. 5, 6, 7 and 8 into a retracted position best seen in FIG. 10 and which will be fully described hereinbelow.

Platform Deployment

Figure 3B:
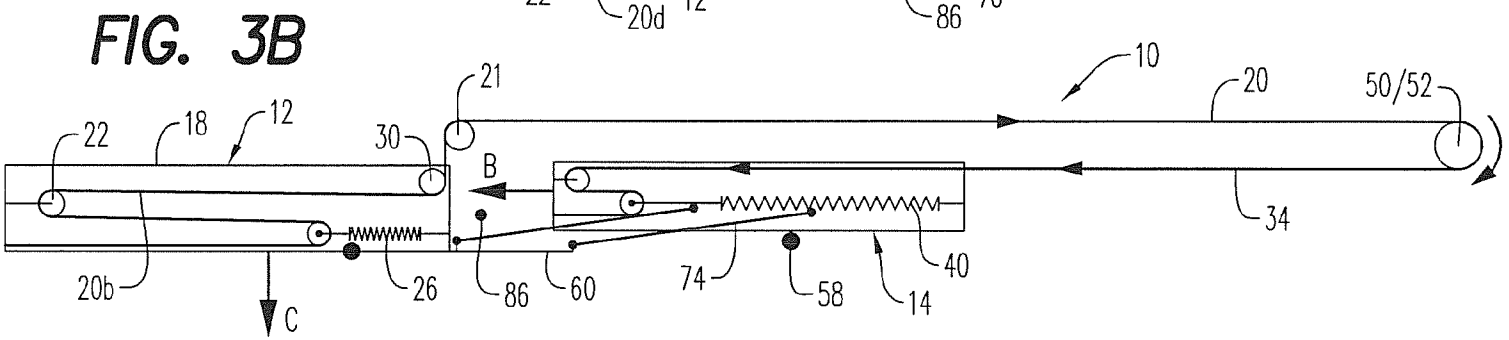
Figure 3C:
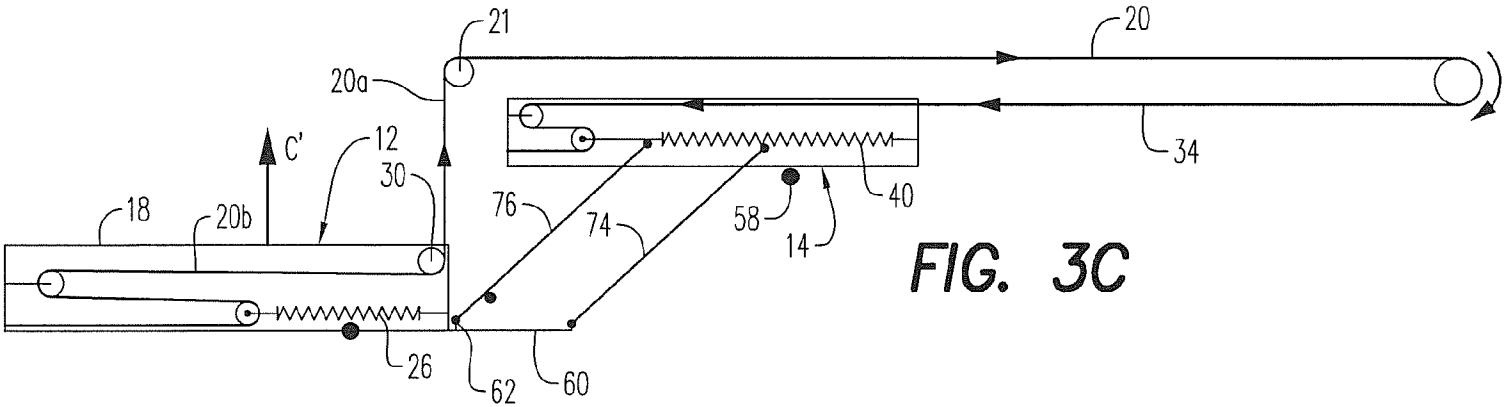

Referring now particularly to FIGS. 3A, 3B and 3C, the deployment or extending of the lifting platform assembly 12 from beneath the undercarriage U of the vehicle V and from within the frame assembly 16 is there sequentially depicted. The winch 48 is actuated so that the cable spools 50 and 52 rotate in the direction of the arrow shown in FIG. 3A. This causes the main cable 20 to retract in the direction of the arrow pulling roller 30 connected as previously described to the proximal edge of the platform 18 in the direction of the arrow on cable portion 20*a*. As the platform guide roller 86 and associated plastic platform guide block 88 are pulled toward the open end of the side guide 78 best shown in FIG. 15, roller 30 approaches the position of being directly beneath support roller 21 best seen in FIG. 12.

The open end of the side guide 78 includes a downwardly formed ramp guide 80 forming the lower portion of the open end of the side guide 78 as best seen in FIG. 15. When the guide roller 86 just exits from the guide ramp 80, the platform 18 controlledly falls downwardly in the direction of arrow C in FIG. 3B. However, the lower control arms 74 are also supported from downward movement on a platform support pivot 58 which as best seen in FIGS. 15 and 18, is rigidly connected just beneath the frame side channel 44 and along transverse axis M. Thus, once the guide roller 86 is released from guide ramp 80, the lower edge of the lower control arm 74 rides on the bearinged platform support pivot 58 to lower the platform dowardly in the direction of arrow C best seen in FIG. 3B. The main cable 20, still under tension between support roller 21 and roller 30, also helps to control the drop of the platform 18. When the lower surface of the platform assembly 12 comes to rest atop the ground or other vehicle support surface, the upper and lower control arm 76 and 74 are in the position best seen in FIGS. 3C and 19 and free of support from the support pivot 58.

To lift the platform assembly 12 in the direction of C', the winch actuator 48 continues in its rotational direction and the carriage cable spool 50 continues to retract the main cable 20 starting to lift the platform in the direction of arrow C' in FIG. 3C. A limit switch 72 best seen in FIGS. 5 and 6, stops the actuator 48 at the upper limit of movement of the platform assembly 12 for wheelchair ingress and egress by the user, the upper position of platform assembly 12 being best seen in FIG. 7. Note the alternate position of the limit switch 72' in FIG. 5.

In FIG. 4, retracting the platform assembly 14 upwardly and horizontally into the frame assembly 12 from the ground G is there shown wherein the roller 30 is initially shown at 30*x*, and the end of the take-up frame is shown at 33*x*. As the carriage cable 34 is pulled by the winch actuator 48 in the direction of the arrows, the platform guide roller 86 begins at position 86*x* to move upwardly and inwardly in the direction of the arrow whereupon at position 86*y*, the guide roller 86 makes contact with the guide ramp 80 at which point the end of the take-up frame is positioned at 33*y*. The winch actuator 48 continuing to pull on the carriage cable 34, the platform guide roller 86 moves to the position 86*z* and the end of the take-up frame moves to the position 33*z* whereupon the lower edge of the lower control arm 74 makes contact with and is supported on the support pivot 58. During this retraction of the platform 18, roller 30 moves from 30*x* to 30*y* to 30*z* shown in phantom with respect to the fixed support roller 21. Continuing retraction of the carriage cable 34 fully retracts the platform assembly 12 and the carriage assembly 14.

Cable Take-Up

During the deployment and retraction of the lifting platform assembly 12 and the intermediate carriage assembly 14, each of the cables 30 and 34 moves at non-linear and non-coincident speeds over the various above-described rollers and pulleys. Therefore, two spring actuated take-up assemblies, which include take-up springs 26 and 40, are also provided. As best seen in FIGS. 2 and 3A, 3B and 3C, one end of the main cable take-up spring 26 is anchored to anchor 27 at platform proximal edge 19 and to a floating pulley 24 at the other end. Tension is preferably established at the least or shortest length of the main cable take-up spring 24 when the platform assembly 12 is in the retracted and stored position. The end of the main cable segment 20*d* is anchored at 28 to the distal edge of the platform 18 and is then fed through the pulley 24 back at 22*c* to a second pulley 22 which is also anchored at the distal edge of the platform 18. Main cable segment 20*b* extends from pulley 22 to the roller 30 then again back to the support roller 21 to reverse and return to the main cable spool 52.

Likewise, a carriage cable take-up spring 40 is anchored at one end 42 within the take-up frame 33 which is positioned in F2 in the retracted position in proximity to the winch actuator 48. The other end of the carriage cable take-up spring 40 is connected a floating pulley 38 which is tensioned by the segments of the carriage cable 34 between the anchor 42 and another pulley 36. Thus, the various segment lengths of the carriage cable 34 vary throughout movement of the lifting platform assembly 12 and the carriage assembly 14 and are taken up by extension and retraction of the pre-tensioned carriage cable take-up spring 40.

Hydraulic Actuator

Referring now to FIGS. 20 to 23, another embodiment of the invention is there shown generally at numeral 100 and depicts an actuator in the form of a linear or hydraulic actuator 110 connected at one end to the frame rear cross member 112 having a hydraulic pump 114 for controlled pressurized fluid flow to activate an elongated ram 118 which extends and withdraws in the direction of arrow J shown in phantom responsive to internal fluid pressure in the actuator 110. This actuator movement causes the a-shaped carriage assembly 104 to also move in the direction of arrow J into up to the position shown in phantom.

As previously described, the carriage assembly 104 includes a plurality of carriage support bearings 138 mounted on an elongated carriage side rail 142 which, in turn, is connected to the carriage side rail 142. These support bearings 138 vertically support the carriage assembly 104 for only sliding or rolling movement within the frame side members 120 of the frame assembly 106. Side bearings 140 are also provided to prevent rattling or any side-to-side movement of the platform assembly 104 within the frame assembly 106. The platform assembly 102 is substantially similar to that previously described and includes the platform guide roller 126 on either side thereof in upper and lower control arms 122 and 124 which are pivotally connected about upper and lower pivot pins 132/134 and 128/130, respectively, to the platform arms 146.

In FIGS. 21 to 23, movement of the platform assembly 102 within and along the length of the frame side members 120 is there shown. From the fully retracted, stored position, the carriage assembly 104 and the platform assembly 102, connected together by parallel upper and lower control arms 124 and 122, respectively, as previously described, is effected by the linear extension of the ram 118 from the linear hydraulic actuator 110. When the platform guide roller 126 reaches the almost fully outwardly extending position shown in phantom, support from the frame side channel 126 terminates at a arcuately downwardly from guide ramp 148. Simultaneously, support from the lower control arm 122 against the support pivot 144 diminishes, allowing the upper and lower control arms 124 and 122 to swing or pivotally fall downwardly in the direction of arrow N, that downward movement terminating when the platform 108 comes to rest against the ground G. Simultaneous support for the platform assembly 102 is achieved between guide rollers 126 on the support guide ramp 148 and the accurately contoured surface 122*a* of the control arm 122 against the support pivot 144. In this embodiment 100, retraction of the platform assembly 102 upwardly and inwardly back into the frame assembly 106 mostly reverse tracks arrow N when the hydraulic pump 114 is reversed and causing the ram 118 to retract into the body of the linear actuator 110.

Referring now to FIG. 24, an alternate embodiment shown at numeral 160 represents a variation of the hydraulic actuator embodiment 100 shown in FIG. 20. In this embodiment 160, the hydraulic actuator 174 is pivotally attached at 176 to the rear cross member 169, the distal end of the ram of the actuator 174 pivotally connected at 178 to a mid point of an elongated leverage arm 180. One end 182 of the leverage arm 180 is pivotally connected to the frame assembly 166 while the other end 184 of the leverage arm 180 is pivotally connected to a tie rod 186. The opposite end of the tie rod at 188 is pivotally connected at 188 to the center of the carriage assembly 164.

Extension of the actuator 174 into the position shown in phantom causes the full lateral extension and then descending movement of the platform assembly 162 as previously described with respect to FIGS. 20 to 23. However, in this embodiment 160, a much shorter actuator movement in the direction of arrow K is required to effect a much larger movement of the carriage assembly 164 in the direction of arrow L causing the desired linear translation of the platform assembly 162 in the direction of arrow M.

Referring to FIGS. 25 to 27, another variation of the apparatus from that shown in FIG. 20 is there shown at numeral 100'. All features of this embodiment 100' are similar to that described in FIG. 100, except for the addition of a platform lowering speed limit assembly 190 and a spring soft stop assembly 202. The platform lowering speed limit assembly 190 includes one or more hydraulic damping mechanisms or shock absorbers 192 connected between the upper pivot pin 134 (shown symbolically as an axis) of the upper control arm 124 and the lower pivot pin 128 (also shown symbolically as an axis) connected between the platform arm 146 and the upper control arm 124. The upper ends 196 of each of the shock absorbers 192 are supported on the upper shock support 194 while the lower ends 200 of the shock absorbers 192 are supported for pivotal movement about the lower pivot pin 128 within the lower shock support 198. Thus, as the platform assembly 102 descends at the outward end of the lateral movement of the platform 108, the lowering movement of the platform 108 as described previously in FIGS. 21 to 23 is slowed as the upper and lower control arms 124 and 122 separate in the direction of arrow M.

The spring soft stop assembly 202 is provided to cushion the sudden movement of the ram 118 responsive to pump pressure valving within pump 114 shown in FIG. 20. Although this soft stop feature may be incorporated into a more sophisticated hydraulic pump arrangement, the opposing compression springs 206 and 208 positioned over spring mounting bolts 210 on either side of a tie bar 204 results in a softening movement of the spring support frame 216 and the carriage assembly 164 to which it is rigidly connected. A limit switch 212 mounted within limit switch mount 214 connected to the frame front cross member 167 makes contact with the spring center frame portion 218 when the ram 118 reaches the fully extended position of the carriage assembly 164'.

Referring now to FIGS. 28 and 29, an alternate embodiment of the platform assembly itself is generally there shown at numeral 222 within the embodiment 220. Typically, the lower surface of the undercarriage U is lower or closer to the ground G than is the rocker panel R and floor F of the vehicle V. Thus, as best seen in FIG. 29, the height of the platform 228 above the ground G the distance shown at 244 is less than necessary to achieve the same vertical height of the top of the platform 228 as is the floor F of the vehicle V.

In this embodiment 220, the platform assembly 222 thus includes an upwardly movable platform 228, the upward movement of which is controlled by a second linear hydraulic actuator 234 which is pivotally connected at one end 250 to a perimeter frame 226 of the platform assembly 222 while the distal end of the ram is pivotally connected at 252 to the side of the platform 228. A series of four platform links 236 and 238 pivotally interconnect the perimeter frame 226 and the movable platform 228 at 248. Thus, the upward movement of the platform 228 a distance 254 is strictly controlled by the pivotal movement of the platform links 236 and 238 while the hydraulic actuator 234, which extends into the length shown at 234' in phantom, causes the platform 228 to lift a distance 254 from the perimeter frame 226 about the pivotal motion of the links 236 and 238.

By this arrangement 220, the upper surface of the platform 228 is elevated to be in elevational alignment with the floor F to facilitate and easier manual transfer from the wheelchair into the seat of the vehicle, or alternately, if this arrangement 220 is connected beneath a side door opening of a vehicle, the user may then easily roll the wheelchair from the elevated platform 228 onto the floor F of the vehicle without further assistance.

While a number of exemplary aspects and embodiments have been discussed above, those of skill in the art will recognize certain modifications, permeations and additions and subcombinations thereof. It is therefore intended that the following appended claims and claims hereinafter introduced are interpreted to include all such modifications, permeations, additions and subcombinations that are within their true spirit and scope.

The invention claimed is:

1. A wheelchair lifting apparatus attachable to an undercarriage of a vehicle, comprising:

a frame positionable directly beneath and attachable to the undercarriage and including an elongated side guide extending along each side of said frame;

a carriage carried for horizontal movement between and along the length of said side guides;

a lifting platform movably carried within said side guides and connected in end-to-end proximity to said carriage for horizontal movement between a retracted position wherein said lifting platform is substantially beneath the undercarriage within said side guides and an extended position wherein said lifting platform is laterally extended from said frame beyond said side guides alongside the vehicle;

a pair of elongated upper and lower control arms pivotally connected at each end thereof in parallel orientation between each side of said lifting platform and a corresponding side of said carriage;

an actuator connected between said frame and said carriage for movement of said carriage and said lifting platform within said side guides between the retracted and extended position;

a support pivot connected to, and inwardly extending from, each said side guide for supporting each corresponding said lower control arm to maintain said lifting platform in a raised position until said lifting platform is in close proximity to the extended position whereupon support of each of said lower control arms by said support pivots diminishes and said platform is gradually lowered upon continued outward movement of said carriage by said actuator;

each of said side guides including a downwardly extending ramp guide formed at a lower portion of an open end thereof to supportively assist said support pivots in facilitating the initial downward movement of said platform.

2. A wheelchair lifting apparatus as set forth in claim 1, wherein:

said actuator is a reversible cable winch.

3. A wheelchair lifting apparatus as set forth in claim 2, further comprising:

a platform cable take-up spring assembly and a carriage cable take-up spring assembly each configured to maintain tension on a main cable extending between said cable winch and said platform and on a carriage cable extending between said cable winch and said carriage, respectively.

4. A wheelchair lifting apparatus as set forth in claim 1, wherein:

said actuator is a linear actuator having a movable ram, a distal end of said ram being pivotally connected to said carriage.

5. A wheelchair lifting apparatus as set forth in claim 4, further comprising:

an elongated leverage arm and tie rod arrangement, said leverage arm pivotally connected at a proximal end thereof to said frame, a distal end of said leverage arm pivotally connected to one end of said tie rod, another end of said tie rod pivotally connected to said carriage;

a distal end of said linear actuator pivotally connected to a mid point of said leverage arm wherein said platform and said carriage move incrementally faster than a distal end of said linear actuator.

6. A wheelchair lifting apparatus as set forth in claim 4, further comprising:

a spring soft start/stop assembly connected between a distal end of said ram and said carriage wherein sudden starting and stopping movement of said ram in said hydraulic actuator is softened when transmitted to said carriage.

7. A wheelchair lifting apparatus as set forth in claim 4, further comprising:

a speed limit connected between said upper and lower control arms for limiting the descending speed of said platform.

8. A wheelchair lifting apparatus as set forth in claim 1, further comprising:

a secondary platform lifting mechanism connected between said platform and a perimeter frame of said platform assembly for lifting said platform higher above the ground or vehicle support surface than the raised position of said platform.

9. A lifting apparatus for attachment to an undercarriage of a vehicle comprising;

a generally flat platform;

a frame and an actuator connected between said frame and a carriage supported for back and forth linear movement within inwardly opposing side guides extending along each side of said frame, movement of said carriage by said actuator deploying and retracting said platform by effecting outward and lowering movement to deploy said lifting platform and raising and inward movement to retract said lifting platform;

two pairs of elongated upper and lower control arms which pivotally connect said lifting platform and said carriage together, each said pair of upper and lower control arms being pivotally connected along horizontal axes at each end thereof to opposing corners of said lifting platform and said carriage, respectively;

a support pivot connected to each side of said frame in close proximity beneath said side guides about a horizontal axis parallel to said control arm pivotal connections, each of said support pivots maintaining supportive contact with each corresponding said lower control arm to support said platform in the raised position until said platform is moved by said actuator toward and in close proximity to said extended position whereupon said platform is lowered to the ground upon continued activation of said actuator;

each of said side guides including a downwardly extending ramp guide formed at a lower portion of an open end thereof to supportively assist said support pivots in facilitating the initial downward movement of said platform.

10. A wheelchair lifting apparatus as set forth in claim 9, wherein:

said actuator is a reversible cable winch.

11. A wheelchair lifting apparatus as set forth in claim 10, further comprising:

a platform cable take-up spring assembly and a carriage cable take-up spring assembly each configured to maintain tension on a main cable extending between said cable winch and said platform and on a carriage cable extending between said cable winch and said carriage, respectively.

12. A wheelchair lifting apparatus as set forth in claim 9, wherein:

said actuator is a linear actuator having a movable ram, a distal end of said ram being pivotally connected to said carriage.

13. A wheelchair lifting apparatus as set forth in claim 12, further comprising:

an elongated leverage arm and tie rod arrangement, said leverage arm pivotally connected at a proximal end thereof to said frame, a distal end of said leverage arm pivotally connected to one end of said tie rod, another end of said tie rod pivotally connected to said carriage;

a distal end of said linear actuator pivotally connected to a midpoint of said leverage arm wherein said platform and said carriage move incrementally faster than a distal end of said linear actuator.

14. A wheelchair lifting apparatus as set forth in claim 12, further comprising:

a spring soft start/stop assembly connected between a distal end of said ram and said carriage wherein sudden starting and stopping movement of said ram in said hydraulic actuator is softened when transmitted to said carriage.

15. A wheelchair lifting apparatus as set forth in claim 12, further comprising:

a speed limit connected between said upper and lower control arms for limiting the descending speed of said platform.

16. A wheelchair lifting apparatus as set forth in claim 9, further comprising:

a secondary platform lifting mechanism connected between said platform and a perimeter frame of said platform assembly for lifting said platform higher above the ground or vehicle support surface than the raised position of said platform.

* * * * *